US007506415B2

(12) United States Patent
Brian

(10) Patent No.: US 7,506,415 B2
(45) Date of Patent: Mar. 24, 2009

(54) SMALL CLOTHING ITEM MANAGEMENT SYSTEM

(76) Inventor: Michael W. Brian, 2108 87th St., Lubbock, TX (US) 79423

( * ) Notice: Subject to any disclaimer, the term of this patent is extended or adjusted under 35 U.S.C. 154(b) by 206 days.

(21) Appl. No.: 11/243,934

(22) Filed: Oct. 5, 2005

(65) Prior Publication Data

US 2006/0143780 A1 Jul. 6, 2006

Related U.S. Application Data

(60) Provisional application No. 60/616,665, filed on Oct. 7, 2004.

(51) Int. Cl.
*A44B 21/00* (2006.01)

(52) U.S. Cl. ..... 24/329; 24/336; 24/DIG. 29

(58) Field of Classification Search ..... 24/543, 24/518, 517, 30.5 R, 30.5 P, 30.5 S, 30.5 W, 24/DIG. 29; 604/325; 132/278, 279, 281
See application file for complete search history.

(56) References Cited

U.S. PATENT DOCUMENTS

| | | | | | |
|---|---|---|---|---|---|
| 4,847,956 | A * | 7/1989 | Levine | ..... | 24/30.5 R |
| 4,976,277 | A * | 12/1990 | Yasuda | ..... | 132/279 |
| 5,477,870 | A * | 12/1995 | Menaged | ..... | 132/279 |
| 5,598,608 | A * | 2/1997 | Naslund | ..... | 24/30.5 R |
| 6,257,251 | B1 * | 7/2001 | Burleson et al. | ..... | 132/279 |
| 6,446,638 | B1 * | 9/2002 | Horman | ..... | 132/275 |
| 6,536,446 | B2 * | 3/2003 | Kimura | ..... | 132/277 |

* cited by examiner

*Primary Examiner*—Robert J Sandy
(74) *Attorney, Agent, or Firm*—Michael A. O'Neil

(57) ABSTRACT

A small clothing item management system holds small clothing items on a beam and prevents damage or loss to the clothing items. The clothing items are secured against a center beam by a flexible strap during the wash and dry cycles of the household laundry process. After completion of the laundry process, the small clothing items remain secured to the center beam for storage.

8 Claims, 4 Drawing Sheets

SMALL CLOTHING ITEM MANAGEMENT SYSTEM

CLAIM OF PRIORITY

This application claims priority of prior provisional application Ser. No. 60/616,665 filed Oct. 7, 2004 the entire content of which is incorporated herein by reference.

TECHNICAL FIELD

The present invention relates in general to clothing holders and organizers and, in particular, to a small clothing item management system facilitating efficient organization of small clothing items during laundry and storage.

BACKGROUND AND SUMMARY OF THE INVENTION

Small clothing items such as socks, handkerchiefs, and the like are generally washed loose among larger clothing items. The smaller items get caught in the washing machine agitator and damaged, get caught and hidden in larger clothing items, and paired or grouped items such as socks get separated. After being laundered, the clothing items must be sorted, folded, and stored. For paired items such as socks, the sorting includes matching pairs together, which is time consuming.

There are several methods that people try in order to prevent losing small items in the laundry, keeping paired items together, and managing storage of paired items; however, existing methods have faults and none addresses the issue of sorting and storage of paired items. For example, there are several mesh-type bags available for washing small and delicate items. Mesh-type bags prevent damage to small items, but do not alleviate the sorting and storage problem at the end of the laundry process. Paired items such as socks can be held together by safety pins, clothes pins or other types of clips or holders, but pins can damage socks by rusting and staining, tearing small holes in the socks, or pulling threads out of the socks. Clothes pins or clips keep items together, but can come unclipped or caught by other articles of clothing, resulting in items becoming separated, or if they remain together, the items must be unclipped for convenient storage.

The present invention comprises a device for holding small clothing items together which overcomes the foregoing and other difficulties which have long since characterized the prior art. In accordance with the broader aspects of the invention, the small clothing item management system comprises a center beam and a flexible strap for securing items thereto.

In accordance with more specific aspects of the invention, a small clothing item management system comprises a rigid center beam and a rigid flexible strap which secures therearound. Clothing items are held on the center beam by the flexible strap. The strap holds the items securely during the wash and dry cycles of laundry and keeps paired items together during laundry folding and storage. Additionally, the clothing items are held flat against the center beam and can be stored either folded, rolled, or laid flat in a drawer or storage container or the like. Both the center beam and strap are constructed with durable materials to withstand the pressure and heat of the wash and dry cycles.

The small clothing item management system prevents loss or damage to small clothing items during the household washing and drying cycles, eliminates the need for sorting at the end of the laundry process, and assists in convenient storage and management of the paired items such as socks.

BRIEF DESCRIPTION OF THE DRAWINGS

A more complete understanding of the present invention may be had by reference to the following Detailed Description when taken in connection with the accompanying Drawings, wherein.

DETAILED DESCRIPTION

Figure 1:
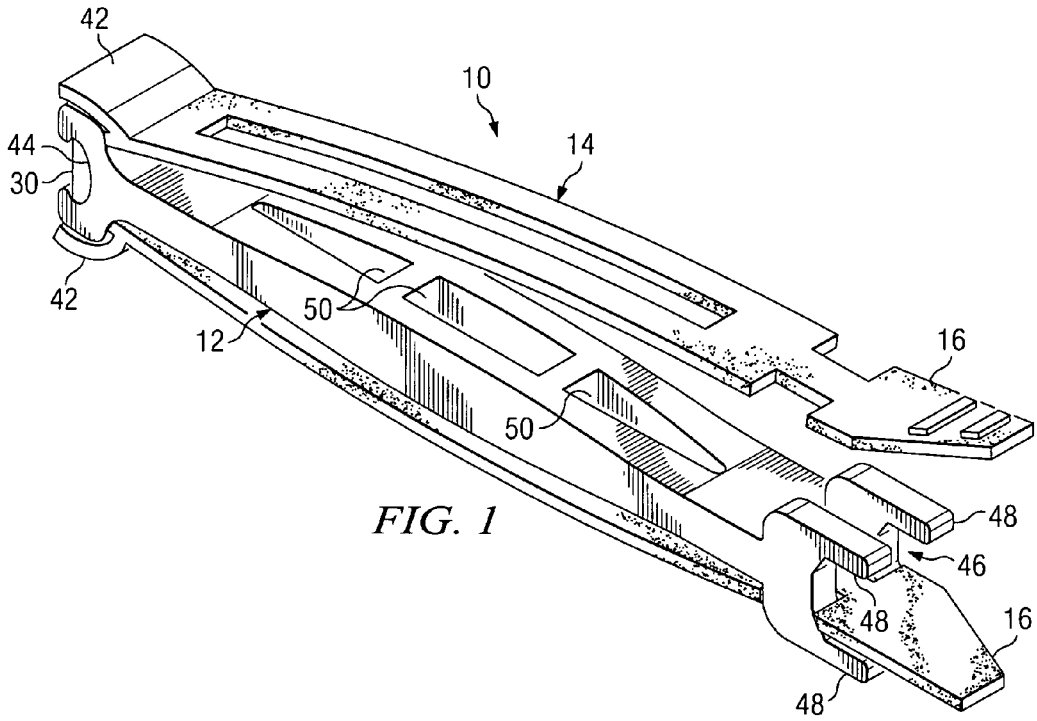
FIG. 1 is a perspective view of a small clothing item management system comprising a first embodiment of the present invention.

Referring now to the drawings and particularly to FIG. 1 thereof, there is shown a small clothing item management system 10 incorporating a first embodiment of the present invention. Small clothing items are held against a center beam 12 by a flexible strap 14 during the washing and drying cycles of laundry, and after the laundry process during storage. The strap 14 wraps around one end of the beam 12 and is secured on both sides at the other end by handles 16.

Figure 2:
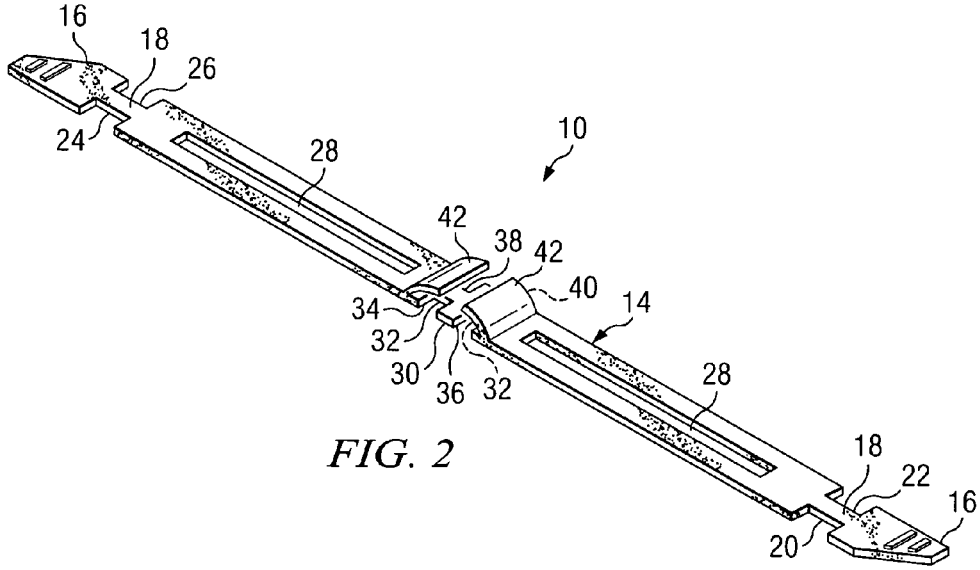
FIG. 2 is a perspective view of the strap of the management system of FIG. 1.

Referring to FIG. 2 there is shown the flexible strap 14. The strap 14 is fabricated from a high strength rubber, a polymeric material, or other materials known to those skilled in the art for enabling the strap 14 to be both flexible and durable At each end of the strap 14 there is provided a handle 16. The handles 16 are connected to the strap by end connectors 18, defined by notches 20, 22, 24, and 26. Cut out of each side of the strap are two drying vents 28 that allow air to pass through to the item of clothing attached underneath. At the center of the strap 14 is a retainer 30. The retainer 30 is connected to the strap 14 by center connectors 32, defined by notches 34, 36, 38, and 40. On each side of the connectors 32 is a retaining flap 42. Each flap 42 covers the connectors 32 and their defining notches 34, 36, 38, and 40.

Referring again to FIG. 1 the center beam 12 is constructed using wood, a plastic material having both high shore D hardness and deflection temperature, or other materials known to those skilled in the art suitable for withstanding repeated exposure to water and high temperatures. The proximal end of the beam 12 comprises a small semi-circular retaining groove 44 which receives the retainer 30. The distal end of the beam 12 comprises a receiving groove 46 with four fingers 48 for receiving and retaining the handles 16. Cut out of the middle of the beam are drying vents 50 to facilitate drying the portion of the clothing item secured against to the beam 12.

Figure 3:
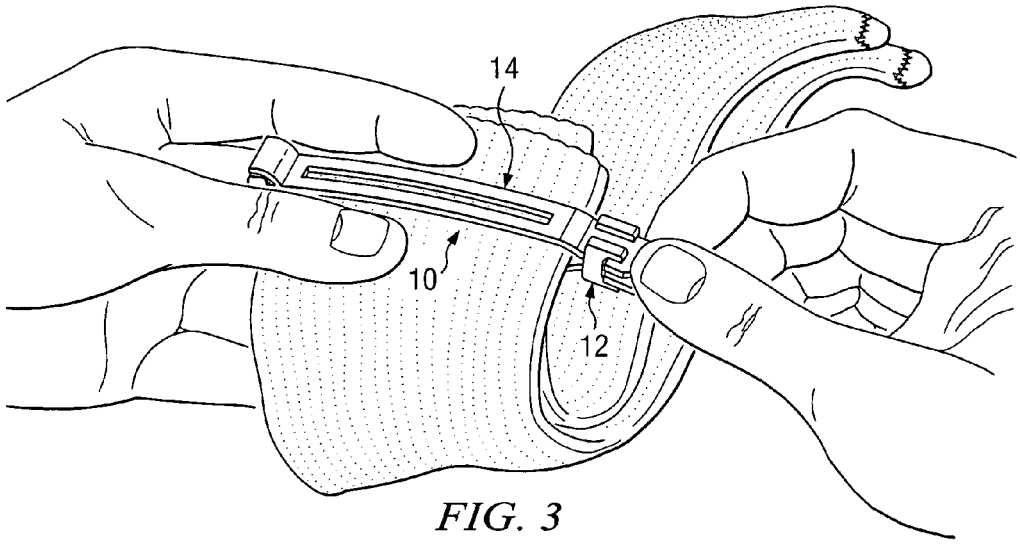
FIG. 3 is an illustration of an initial step in the utilization of the management system of FIG. 1.

Referring to FIG. 3, clothing items are held in place against the center beam 12 by the strap 14. The retainer 30 fits into the semi-circular retaining groove 44 to hold the strap 14 on the beam 12. The center connectors 32 fit and extend through openings of the retaining groove 44, with the retaining flaps 42 resting on top of either side of the retaining groove 44. A clothing item is placed against the beam 12 and one side of the strap 14 is stretched across the clothing item, placing the end connector 18 between the fingers 48 of the receiving groove 46. Once the connector 18 is in place and the handle 16 is released, the handle 16 is held in place by the tension against the fingers 48. Another item is placed on the other side of the beam 12 in the same manner.

Figure 4:
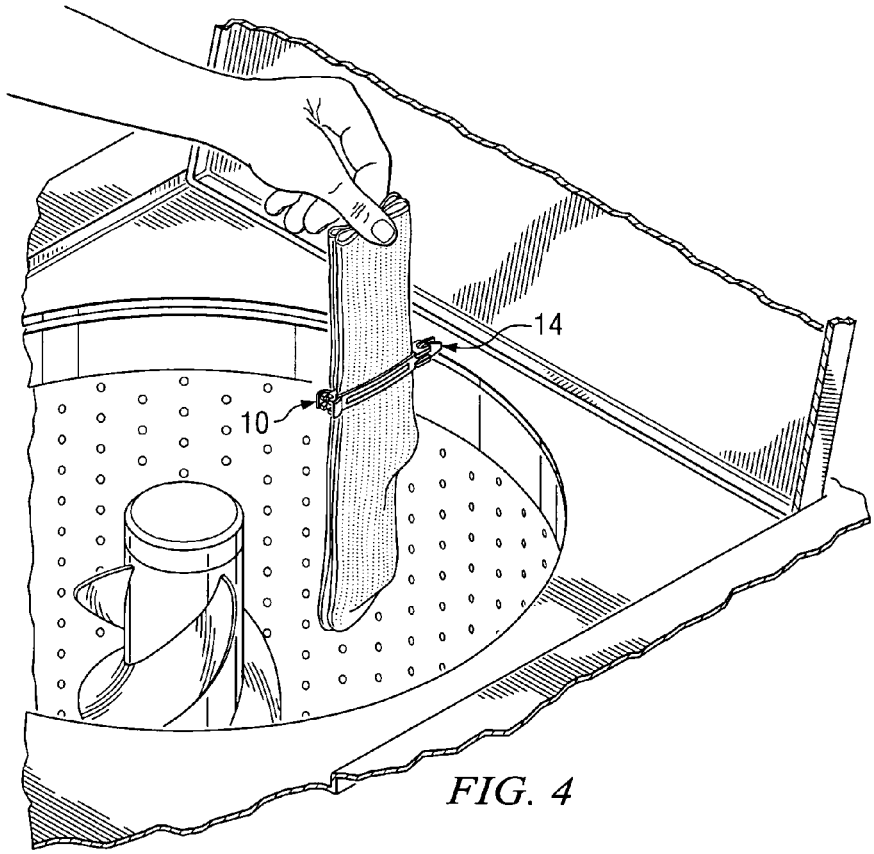
FIG. 4 is an illustration of a later step in the utilization of the management system of FIG. 1.

FIG. 4 shows the management system 10 used to retain clothing items during the wash cycle.

Figure 5:
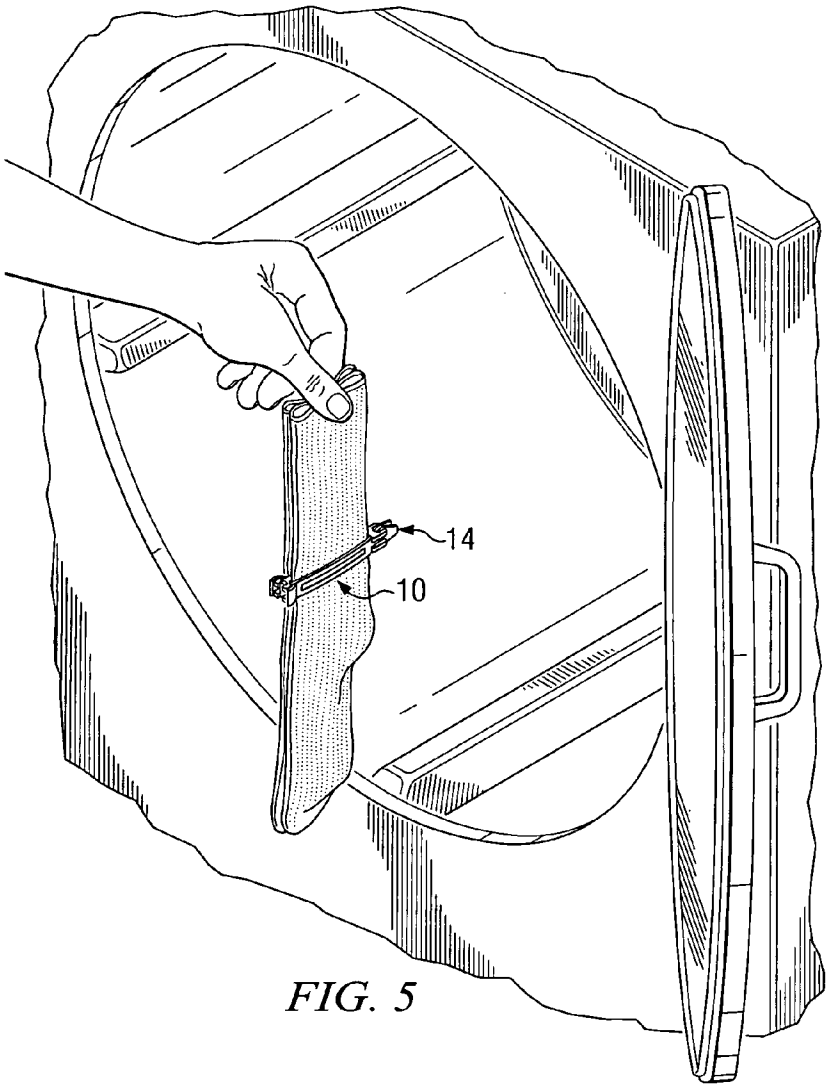
FIG. 5 is an illustration of a somewhat later step in the management system of FIG. 1.

FIG. 5 shows the management system 10 used to retain clothing items during the drying cycle. An important feature of the invention comprises the fact that the management system 10 is quiet in the dryer.

Figure 6:
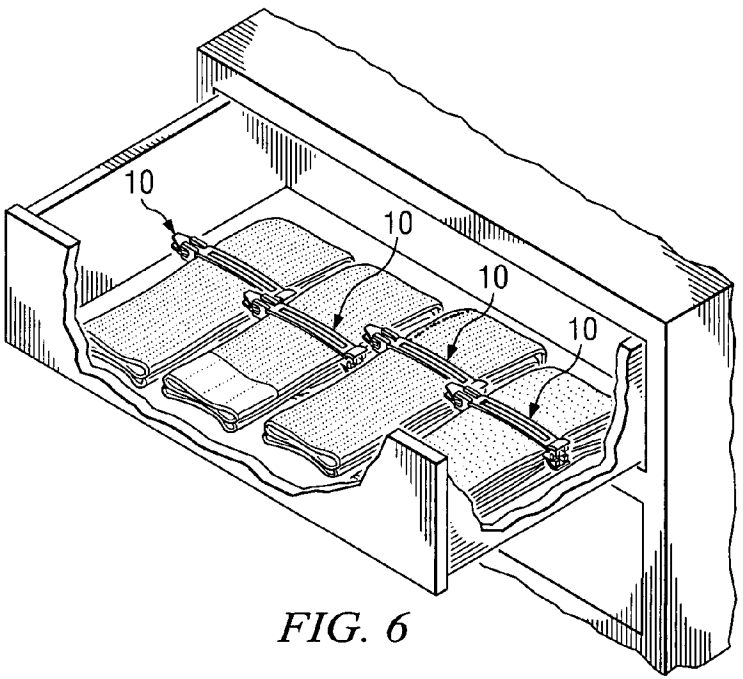
FIG. 6 is an illustration of a still later step in the utilization of the management system of FIG. 1.

FIG. 6 shows the management system 10 used in the storage of the small clothing devices. After completing the washing and drying cycles of the laundry, paired items such as socks remain secured against the beam 12 for storage. Each item is laid flat, folded, wrapped around the clothing-holder device, or otherwise manipulated for storage.

Figure 7:
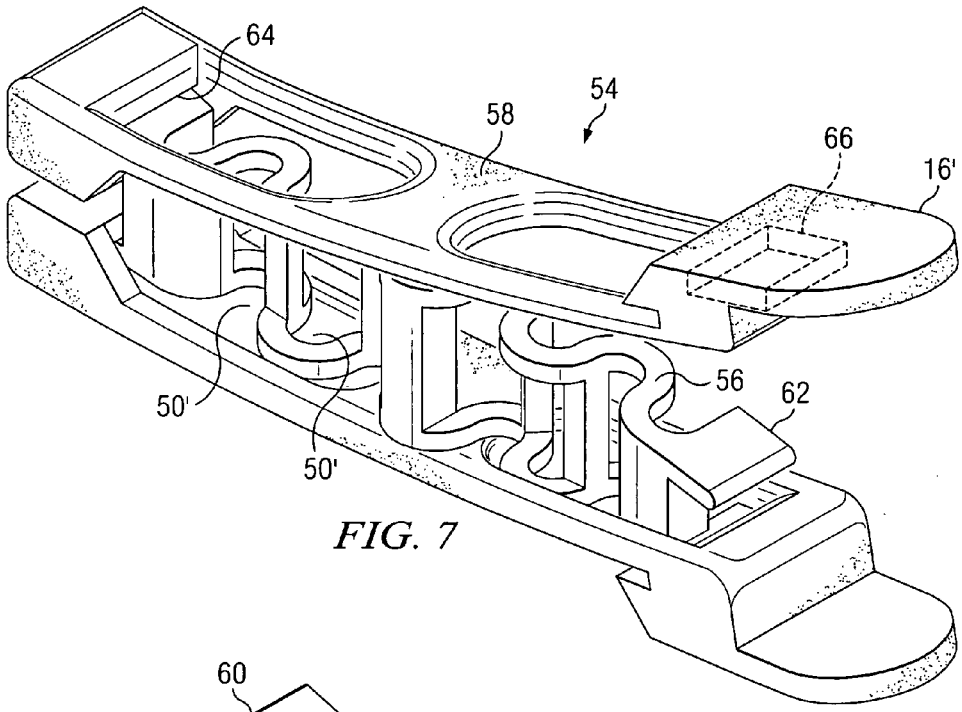
FIG. 7 is a perspective view of a small clothing item management system comprising a second embodiment of the present invention.

FIG. 7 shows a small clothing item management system 54 incorporating a second embodiment of the present invention. Many of the component parts of the small clothing item management system 54 are substantially identical in construction and function to component parts of the small clothing item management system 10 illustrated in FIGS. 1 through 6 and described hereinabove in conjunction therewith. Such identical component parts are designated in FIG. 7 with the same reference numerals utilized above in the description of the small clothing item management system 10, but are differentiated therefrom by means of a prime (') designation.

The small clothing item management system 54 differs from the small clothing item management system 10 in that the small clothing item management system 54 comprises a center beam 56 having a serpentine shape with multiple drying vents 50' on each side thereof. The serpentine shape of the center beam 56 enables more air flow to the portions of a small clothing item affixed to the beam 56. The small clothing item management system 54 comprises two flexible straps 58 secured on the top and bottom of the center beam 56 instead of one continuous strap 14.

The proximal end of each strap 58 secures onto the proximal end of the beam 56 leaving the distal end of the strap 58 unfastened while clothing items are placed against the beam 56. The strap 58 is received onto strap retaining members 60 on the proximal end of the beam 56, the retaining member 60 slightly tapering outward thereby facilitating a secure mating engagement between the strap 58 and the beam 56. After a small clothing item is placed against the beam 56 the distal end of the strap 58 fastens onto a receiving member 62 on the distal end of the beam 56.

Figure 8:
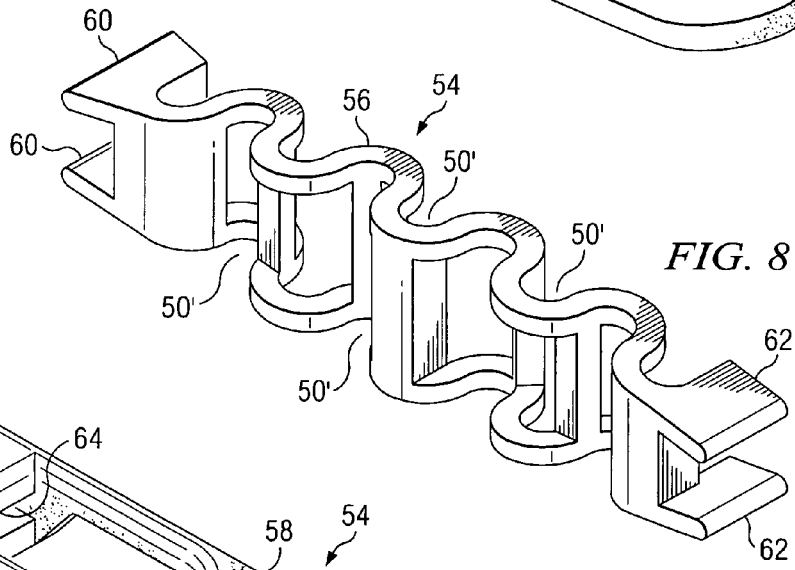
FIG. 8 is a perspective view of the center beam of the small clothing item management system shown in FIG. 7.

FIG. 8 illustrates the center beam 56 of the small clothing item management system 54. The beam 56 is constructed using wood, a plastic material having both high shore D hardness and deflection temperature, or other materials known to those skilled in the art suitable for withstanding repeated exposure to water and high temperatures.

Figure 9:
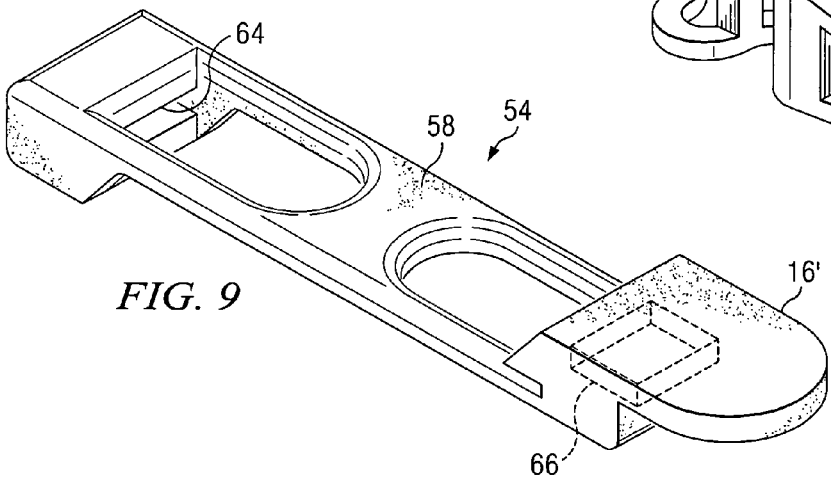
FIG. 9 is a perspective view of the flexible strap of the small clothing item management system shown in FIG. 7.

FIG. 9 illustrates the flexible strap 58 of the small clothing management system 54. The strap 58 comprises a retaining aperture 64 on the proximal end thereof for securing the strap 58 onto the proximal end of the center beam 56. The distal end of the strap 58 comprises a fastening aperture 66 for fastening the strap 58 onto the beam 56 over a small item of clothing placed thereon. A handle 16' on the distal end of the strap 58 enables a user the better grasp the strap 58 when fastening it onto the beam 56 and covers the end of the beam 56 such that the small clothing item management system 54 is quiet in the dryer. The strap 58 is fabricated from a high strength rubber, polymeric material, or other materials known to those skilled in the art which enable the strap 58 to be both flexible and durable.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

The invention claimed is:

1. A small clothing item management system for use in household clothing management comprising:

a rigid center beam having a top side, a bottom side, a proximal end, and a distal end; and a flexible strap having a first side, a second side, a first end, and a second end for retaining clothing items in engagement with the beam;

wherein the flexible strap wraps around the proximal end of the beam such that the first side of the flexible strap faces both the top side and bottom side of the beam and the first end and the second end of the strap fasten to the distal end of the beam.

2. The small clothing item management system according to claim 1 wherein the proximal end of a center beam has a retaining groove to which the flexible strap secures.

3. The small clothing item management system according to claim 2 wherein the flexible strap comprises handles at the first end and the second end such that clothing items are held onto the center beam by extending the handles until said handles are received in at least one retaining member at the distal end of the center beam.

4. The small clothing item management system according to claim 1 wherein the center beam comprises dryer vents enabling airflow to the portion of the small clothing item engaged with the center beam.

5. The small clothing item management system according to claim 1 wherein the center beam comprises wood.

6. The small clothing item management system according to claim 1 wherein the center beam comprises a plastic material having a high shore D hardness and deflection temperature.

7. The small clothing item management system according to claim 1 wherein the strap comprises rubber.

8. The small clothing item management system according to claim 1 wherein the strap comprises a polymeric material.

* * * * *